US011884500B2

(12) United States Patent
Rappel et al.

(10) Patent No.: US 11,884,500 B2
(45) Date of Patent: Jan. 30, 2024

(54) PARAMETERIZATION OF A TRACTIVE FORCE CONTROLLER

(71) Applicant: B&R INDUSTRIAL AUTOMATION GMBH, Eggelsberg (AT)

(72) Inventors: Lukas Stefan Rappel, Eggelsberg (AT); Ulrich Anschuber, Eggelsberg (AT); Ralf Skotschek, Eggelsberg (AT); Martin Staudecker, Eggelsberg (AT)

(73) Assignee: B&R INDUSTRIAL AUTOMATION GMBH, Eggelsberg (AT)

( * ) Notice: Subject to any disclaimer, the term of this patent is extended or adjusted under 35 U.S.C. 154(b) by 183 days.

(21) Appl. No.: 17/501,435

(22) Filed: Oct. 14, 2021

(65) Prior Publication Data

US 2022/0119215 A1 Apr. 21, 2022

(30) Foreign Application Priority Data

Oct. 15, 2020 (AT) ..... A 50885/2020

(51) Int. Cl.
*B65H 23/188* (2006.01)
*B65H 23/04* (2006.01)
*B65H 23/198* (2006.01)

(52) U.S. Cl.
CPC ..... *B65H 23/1888* (2013.01); *B65H 23/044* (2013.01); *B65H 23/198* (2013.01);
(Continued)

(58) Field of Classification Search
CPC ..... B65H 23/1888; B65H 23/044; B65H 23/198; B65H 2515/31; B65H 2553/51;
(Continued)

(56) References Cited

U.S. PATENT DOCUMENTS 6,845,282 B2 * 1/2005 Franz ..... B65H 23/1825 700/122
10,029,873 B2 7/2018 Ikeda et al.
(Continued)

FOREIGN PATENT DOCUMENTS

DE 11 2014 005 964 9/2016
EP 1790601 A2 * 5/2007 ..... B65H 23/1888
(Continued)

OTHER PUBLICATIONS

Kugi, Chapter 5 of Dr. Andreas Kugi's lecture notes for the lecture and exercise on automation at TU Wien for the winter semester 2019/2020.

(Continued)

*Primary Examiner* — Seung H Lee
(74) *Attorney, Agent, or Firm* — GREENBLUM & BERNSTEIN, P.L.C.

(57) ABSTRACT

Method and parameterization unit for parameterization of a tractive force controller of a controlled roller of a web-processing machine, the tractive force controller controlling a speed of the controlled roller in order to transport a material on the web-processing machine from the controlled roller to a further roller or from a further roller to the controlled roller at a line speed and while being subjected to the tractive force. The method includes, during a standstill test at a line speed of zero, increasing the tractive force to an identification tractive force, preferably 90% of a predetermined standstill tractive force operating point, to determine standstill system parameters of the tractive force system, to calculate standstill controller parameters of the tractive force controller from the standstill system parameters of the tractive force system, preferably by a frequency characteristic method, and to parameterize the tractive force controller using the standstill controller parameters.

27 Claims, 3 Drawing Sheets

(52) U.S. Cl.
CPC ..... *B65H 2515/31* (2013.01); *B65H 2553/51* (2013.01); *B65H 2801/21* (2013.01)

(58) Field of Classification Search
CPC ..... B65H 2801/21; B65H 2513/11; B65H 2515/37; B65H 2557/24; B65H 2557/61; B65H 2557/63; B65H 23/1825; B65H 23/1955; B65H 23/18; B65H 59/10; B65H 59/40; G05B 13/024
See application file for complete search history.

(56) References Cited

U.S. PATENT DOCUMENTS

| | | | | |
|---|---|---|---|---|
| 11,254,535 | B2 * | 2/2022 | Schubring | B65H 26/08 |
| 2002/0123417 | A1 * | 9/2002 | Cote | B65H 23/188 493/34 |
| 2017/0174461 | A1 | 6/2017 | Kimura et al. | |

FOREIGN PATENT DOCUMENTS

| | | |
|---|---|---|
| JP | 59-128150 | 7/1984 |
| WO | 2016/157661 | 10/2016 |
| WO | 2018/025326 | 2/2018 |

OTHER PUBLICATIONS

Kemmetmüller et al., "Chapter 1.3.4 of Dr. Wolfgang Kemmetmüller and Dr. Andreas Kugi's lecture notes for the "Regelungssysteme" [control systems] lecture at TU Wien for the 2018/2019 winter semester."

Austria Search Report conducted in counterpart Austria Appln. No. A 50885/2020 (dated Jun. 17, 2021).

* cited by examiner

PARAMETERIZATION OF A TRACTIVE FORCE CONTROLLER

CROSS-REFERENCE TO RELATED APPLICATION

This application claims the priority under 35 U.S.C. § 119(a) of Austria Application No. A50885/2020 filed Oct. 15, 2020, the disclosure of which is expressly incorporated by reference herein in its entirety.

BACKGROUND

1. Field of the Invention

The present invention relates to a method for the parameterization of a tractive force controller of a controlled roller of a web-processing machine, the tractive force controller controlling the tractive force via a speed of the controlled roller in order to transport a material on the web-processing machine from the controlled roller to a further roller or from a further roller to the controlled roller at a line speed and while being subjected to the tractive force, as well as to the use of a tractive force controller parameterized according to the method according to the invention for controlling a speed of a controlled roller in a web-processing machine, to transport material from the controlled roller to another roller or from another roller to the controlled roller at a line speed and while being subjected to the tractive force. Furthermore, the present invention relates to a parameterization unit for the parameterization of a tractive force controller of a controlled roller of a web-processing machine, on which a material is transported from the controlled roller to a further roller or from a further roller to a controlled roller at a line speed and while being subjected to a tractive force, the tractive force controller being designed to control the tractive force via a speed of the controlled roller.

2. Discussion of Background Information

In a web-processing machine, a material in the form of webs, foils, tubes, wires or tapes is transported at a line speed along a transport path and processed into a product or intermediate product in a processing process. Metal, plastics, carbon fiber, textile, paper, composite material, etc. can be provided as the material. The material is wound up on a winder (roll, roller, drum, etc.) as a wound product, unwound from the winder and processed in sequence. Uncontrolled stretching or compression of the material has negative effects both on the properties of the material itself and on the quality of the processing within the web-processing machine. It can be provided that the product or intermediate product is wound up again on a winder at the end of the processing process or is fed to a further (processing) process.

During the manufacturing process, the material is subjected to tractive force. This tractive force results from slip-free transport of the material between rollers, for example the winder and a traction roller. The traction roller is provided with a pressure roller to transport the material between the traction roller and the pressure roller along the transport path without slipping. The material is thus transported between the winder and the traction roller at a line speed and is tensioned with tractive force during this time. In principle, both rollers, i.e. the winder and the traction roller, are driven. A target speed, which is preferably generated centrally, is therefore specified for both axes. It is intended that only one of the rollers (preferably the winder) is controlled by adding a correction speed to the target speed because controlling both rollers can lead to instability of the tractive force.

The uniform removal (i.e. uniform unwinding) of the material from the winder, even under different framework conditions, such as geometric irregularities, is an essential prerequisite for the quality of the product or intermediate product. For example, an out-of-round winder can influence the tractive force so strongly that it is hardly possible for the tractive force controller to correct this influence. A fluctuating tractive force can also occur due to irregularly wound material or a lateral offset during winding. In particular, when the line speed of the material is accelerated to a working speed, the tractive force controller makes a contribution. Thus, a tractive force controller is used in particular when an exact tractive stress is to be guaranteed in the material in all phases of the production process. In contrast to tractive force management, tractive force control has a measuring unit that measures the actual tractive force in the material, which is fed back to the tractive force controller.

A controlled slave (usually the winder) and a master are provided in tractive force control, a closed control loop being present. The slave, like the master, has a speed, the tractive force controller applying a correction speed to the speed of the slave, with which the tractive force is adjusted. The correction speed is determined by the tractive force controller based on the calculated actual tractive force and a specified target tractive force.

Different influencing variables, for example the diameter of the material and/or the current line speed, are preferably taken into account in the tractive force control in order to ensure optimal processing of the material. If suitable devices are provided, for example the diameter of the material can be measured precisely. If the diameter of the material is not measured because this is not provided for or not possible, an estimate of the diameter can be used.

The controller parameters of the tractive force controller are usually only determined when the web-processing machine is put into operation under production conditions. The process is very time-consuming and the user must have extensive process knowledge in order to obtain useful results.

The controller parameters can also be determined automatically.

DE 11 2014 005 964 T5 shows such a method, wherein the tractive force is slowly increased to a tractive force operating point and the parameterization of the tractive force controller is started when the tractive force operating point is reached.

SUMMARY

Embodiments ensure simple and automatic parameterization of a tractive force controller of a web-processing machine.

According to embodiments, during a standstill test at a line speed of zero, the tractive force is increased to an identification tractive force, preferably 90% of a predetermined standstill tractive force operating point, in order to determine the standstill system parameters of the tractive force system and to calculate standstill controller parameters of the tractive force controller from the standstill tractive force system, preferably by a frequency characteristic method, the tractive force controller being parameterized using the standstill controller parameters. Furthermore, embodiments include a parameterization unit that is designed to increase the tractive force during a standstill test at a line speed of zero to an identification tractive force, preferably 90% of a predetermined standstill tractive force operating point, in order to determine standstill tractive force parameters of the tractive force system and calculate standstill controller parameters of the tractive force controller from the standstill system parameters of the standstill tractive force system, preferably by a frequency characteristic method, and to parameterize the tractive force controller using the standstill controller parameters. The identification tractive force is selected in such a way that neither the material nor a component of the web-processing machine is damaged and is therefore also dependent on the selection of the standstill tractive force operating point. In principle, an identification tractive force in the amount of over 100% of the predetermined standstill tractive force operating point is also possible. By using a parameterization unit, the controller parameters can be determined automatically. The described method, including the standstill test, creep test, speed test, etc., can be carried out automatically by the parameterization unit. The (standstill) tractive force system is preferably modeled as an integrator. The integrator amplification is largely dependent on the material parameters. A material having high stiffness has a high amplification. Consequently, a change in length of a material having high stiffness leads to a higher tractive force in the material than the same change in length of a material having comparatively lower stiffness.

Therefore, an oscillation is not, as disclosed, for example, in the publication DE 11 2014 005 964 T5, applied to the tractive force, but the tractive force controller is operated at a standstill (line speed of zero) and at a tractive force equal to an identification tractive force. The modulus of elasticity of the material can be calculated directly from the system parameters of the tractive force system. Since the controller parameters, preferably PI controller parameters of a PI tractive force controller, are determined quickly and automatically, no control technology knowledge and only little process knowledge is required for a user. The system parameters of the tractive force system and the controller parameters can thus be determined automatically. The controller parameters are optimally matched to given requirements, such as a rise time or overshoot, which would only be possible with a lot of effort if the controller parameters were to be determined manually.

The standstill controller parameters of the tractive force controller can be calculated from the standstill system parameters of the standstill tractive force system by a frequency characteristic method. The frequency characteristic method is used in the frequency domain. Requirements for the transient response of the responses of the closed control loop to certain selected test functions are considered and transferred to requirements for the Bode diagram of the open control loop. The transient response of the closed control loop is assessed on the basis of the parameters rise time (measure of the speed), overshoot (measure of the degree of damping) and permanent control deviation (measure of the steady-state accuracy). These parameters of the temporal behavior of the step response of the closed control loop are related to the frequency response of the open loop. The rise time is related to the crossover frequency via approximation relationships. The crossover frequency separates those frequencies that are amplified by the open control loop from those that are weakened by the open control loop, whereby the crossover frequency is a measure of the bandwidth of the open control loop, the dynamics of the closed control loop becoming faster as the crossover frequency increases. The percentage overshoot can be related to the phase reserve via an approximation relationship. The phase reserve is a measure of the distance to the stability limit, such that a reduction in the phase reserve increases the tendency to oscillate, i.e. the overshoot. The remaining control deviation, on the other hand, is directly related to the amplification factor of the transfer function of the open loop. The frequency characteristic method is basically known, which is why it is not described in more detail here. For example, see Chapter 5 of Dr. Andreas Kugi's lecture notes for the lecture and exercise on automation at TU Wien for the winter semester 2019/2020.

Before being increased to the identification tractive force, the tractive force is preferably increased to a tensile tractive force, preferably 10% of the standstill tractive force operating point. This ensures that the material is under mechanical tension at the start of the standstill test.

The tractive force controller can be parameterized using the standstill controller parameters, and the tractive force can be increased to the standstill operating tractive force. After the tractive force operating point has been reached, a jump in tractive force is applied to the tractive force in order to determine the quality of the standstill controller parameters based on a first standstill quality step response, which is preferably done using the recursive best fit method, i.e. using the residual square sum. The standstill controller parameters are calculated on the basis of the standstill system parameters. Furthermore, a step response of the closed control loop is measured, compared with an expected step response of the identified closed controlled system, and the residual square sum is calculated.

The residual square sum is a quality criterion for the accuracy of the identified model. If the result meets the expectations, the standstill test is complete. Otherwise the test can be repeated with new requirements for the parameterization of the tractive force controller.

A creep test is preferably carried out after the standstill test, the tractive force controller being parameterized using the standstill controller parameters, and a first operating line speed and a tractive force at the level of a first tractive force operating point being provided. A jump in tractive force is applied to the tractive force, a creep step response is determined and fine system parameters of the tractive force system are identified from the creep step response, preferably by a (recursive) least squares method. Fine controller parameters are calculated from the creep step response and the fine system parameters, preferably using the frequency characteristic method, and the tractive force controller is parameterized using the fine controller parameters. The creep test is therefore used to optimize the controller parameters determined in the standstill test. The result of this optimization is the fine controller parameters.

The jump in tractive force also results in a change in the circumferential speed of the axis. The response to the jump in tractive force and the associated change in the circumferential speed of the winder is called the creep step response.

The (recursive) least square method (i.e. the method of least squares in the recursive variant (RLS)) uses a parametric model, preferably the ARX (autoregressive with exogenous input) model, in the form of a classified model structure. The algorithm is based on the least squares method and is used to estimate model parameters in the identification of linear systems. The optimization problem is to be chosen in such a way that the square of the difference between measurement and model data is minimized. Therefore, the solution that minimizes the quadratic error is sought. By setting the derivation of the optimization problem to zero, the desired parameter vectors (optimal solution) can be calculated. The recursive variant allows minimal computational effort when adding new data because the previous result is used as a starting point and the estimated value of the parameter vector is improved with each new measurement. The RLS algorithm requires at a maximum as many recursion steps as parameters to be identified for a good result. The starting values must be chosen sensibly. Only recursiveness enables online use for system identification. The (recursive) least square method is known in principle, which is why it is not described in more detail here. For example, see Chapter 1.3.4 of Dr. Wolfgang Kemmetmüller and Dr. Andreas Kugi's lecture notes for the "Regelungssysteme" [control systems] lecture at TU Wien for the 2018/2019 winter semester.

Basically, a creep test can also be carried out without a standstill test having been carried out beforehand if coarse controller parameters have been calculated beforehand and the tractive force controller is parameterized using these coarse controller parameters. In the case of a first operating line speed and a tractive force at the level of a first tractive force operating point, a jump in tractive force can be applied to the tractive force and a creep step response can be determined, whereupon fine system parameters of the tractive force system are identified from the creep step response and fine controller parameters are calculated from the creep step response and the fine system parameters.

The coarse control parameters can be determined manually, for example by a manual analysis of the step response of the closed control loop. A tractive force controller, for example in the form of a PI controller, a PID controller, a state controller, etc., can be designed for a line speed of zero. A suitable value for the proportional amplification is only found by first setting the integration time to zero for all tests. Very conservative starting values are preferably chosen for the amplification until the correct value range has been found. The amplification is increased until a slight oscillation is visible and the step response corresponds to the expectations. In the case of a line speed of zero, usable results can be achieved with a pure P controller because the system has an integrating behavior at a line speed of zero. However, for continuous operation, i.e. a line speed greater than zero, an integral component of the tractive force controller is absolutely necessary in order to avoid any permanent control deviation. Therefore, the integral component of the tractive force controller must be varied as soon as a suitable proportional amplification has been found. The integration time of the controller is selected in such a way that the requirements provided for rise time and overshoot are met. A shorter integration time leads to the target value being reached more quickly, but an overshoot tends to occur. A longer integration time has the opposite effect. The setting of the integration part is made at the discretion of the user.

The modulus of elasticity and/or the length of the material for the first operating line speed can be calculated from the fine line parameters. The product of the modulus of elasticity and the cross-sectional area of the material is preferably determined as the fine system parameters, it being possible to calculate the modulus of elasticity directly if the cross-sectional area is known.

A jump in tractive force can be applied to the tractive force in order to determine the quality of the fine controller parameters for the first operating line speed using a creep quality step response, preferably by the best fit method. A high quality of the controller parameters ensures the mechanical stability of the material and thus the quality of the production result, especially during acceleration phases, deceleration phases, high line speeds, etc. This reduces the production of rejects and waste.

A speed test is preferably carried out after the creep test, the tractive force controller being parameterized using the fine controller parameters, a second operating line speed and a tractive force at the level of a second tractive force operating point being provided. A jump in tractive force is applied to the tractive force, a speed test step response is determined and further fine-line parameters of the tractive force system are identified therefrom. Further fine controller parameters can be determined from the speed test step response and the other system parameters, whereby the tractive force controller can be parameterized using the fine controller parameters. The reaction to the jump in tractive force and the associated jump in the circumferential speed of the winder is referred to as the speed test step response.

The speed test is therefore used to optimize the fine controller parameters determined in the creep test for the first operating speed for the second operating speed. The result of this optimization is the further fine controller parameters. In addition to the control parameters for the first operating line speed, there are also control parameters for a second operating line speed. The second operating line speed is preferably selected to be maximum in order to obtain control parameters for a maximum operating line speed.

Furthermore, additional fine controller parameters for additional operating line speeds can be calculated from the fine controller parameters and the further fine controller parameters, for example by interpolation. This determination of additional controller parameters for additional operating line speeds is particularly efficient if the first operating line speed was selected to be low and the second operating line speed was selected to be maximum.

It is also possible to determine additional fine controller parameters for additional operating line speeds from the fine system parameters and the fine controller parameters, which can be done, for example, by a coefficient comparison.

The standstill controller parameters can be saved, extrapolation speed controller parameters for a number of extrapolation line speeds being extrapolated from the standstill controller parameters, and the associated extrapolation speed controller parameters for the parameterization of the tractive force controller can be called up when the web-processing machine is operating at a line speed within the range of one of the extrapolation line speeds. For this purpose, the standstill system parameters identified at a standstill as well as the desired line speed can be used in the general transfer function of the tractive force system and the controller design for this system can be carried out.

The additional fine controller parameters for the additional operating line speeds are preferably stored and, during the operation of the web-processing machine at a line speed within the range of the respective additional operating line speed with the associated fine controller parameters, the associated additional fine controller parameters are called up to parameterize the tractive force controller and the tractive force controller is parameterized using the associated additional fine controller parameters.

The fine controller parameters for the first operating line speed can also be stored, and during operation of the web-processing machine at a line speed within the range of the first operating line speed, the fine controller parameters for the parameterization of the tractive force controller can be called up and the tractive force controller can be parameterized using the fine controller parameters.

Likewise, the other fine controller parameters for the second operating line speed can be stored and called up when the web-processing machine is operating at a line speed within the range of the second operating line speed to parameterize the tractive force controller and the tractive force controller can be parameterized using the further fine controller parameters.

In this way, a parameter set of various additional fine controller parameters can be created for various additional operating line speeds, which can be accessed as required during operation of the web-processing machine in order to parameterize the tractive force controller.

The tractive force controller, parameterized according to the method according to the invention, can be used to control the tractive force of a material in a web-processing machine, the material being transported from a controlled roller to a further roller or from a further roller to a controlled roller at a line speed and while being subjected to the tractive force.

Other exemplary embodiments and advantages of the present invention may be ascertained by reviewing the present disclosure and the accompanying drawing.

BRIEF DESCRIPTION OF THE DRAWINGS

The present invention will be explained below in greater detail with reference to FIGS. 1 to 5, which show exemplary advantageous embodiments of the invention in a schematic and non-limiting manner. In the drawings.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
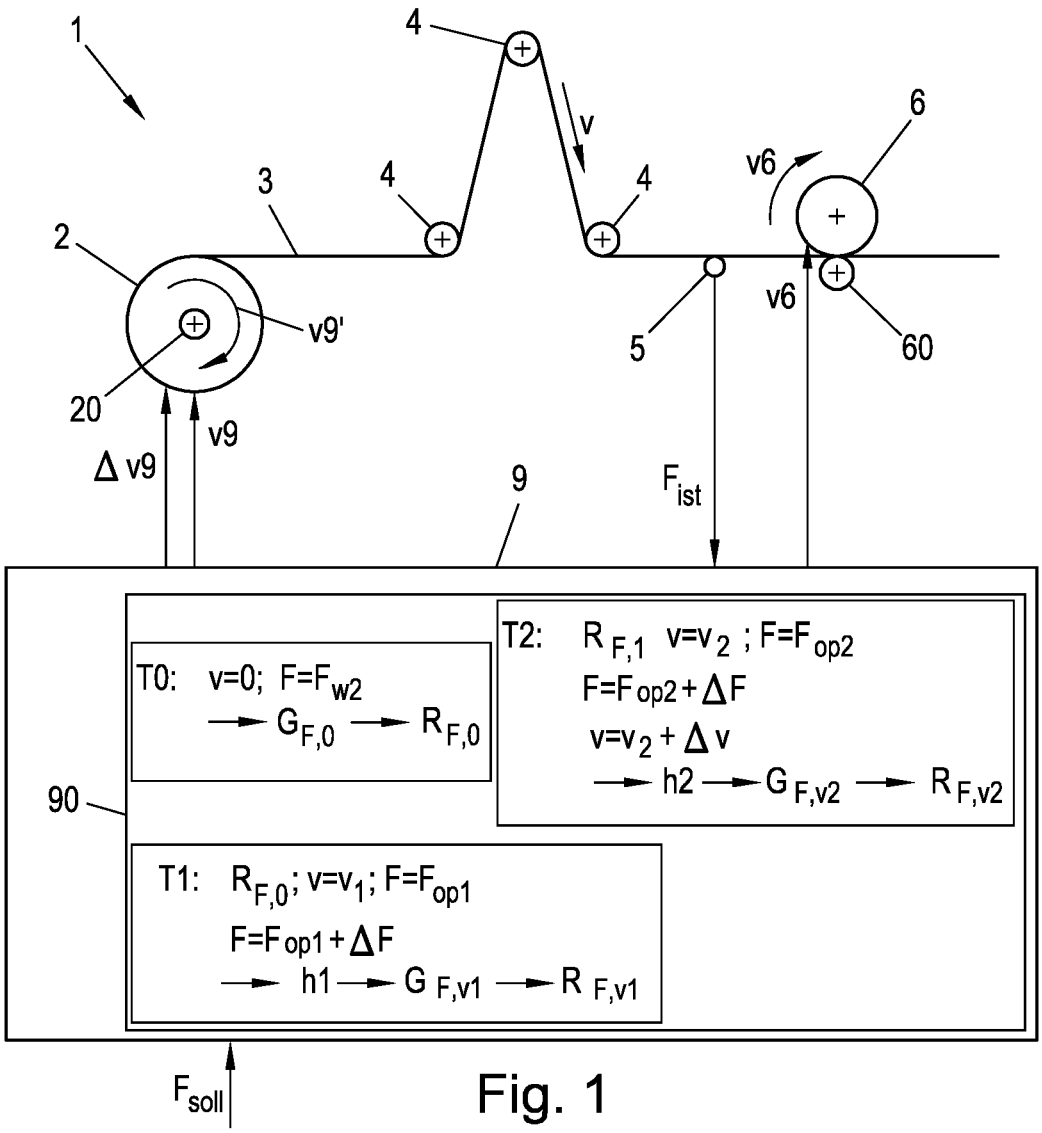
FIG. 1 shows a general web-processing machine.

FIG. 1 shows a web-processing machine 1 for continuous processes. A winder 2 is provided as a controlled roller, which winder is designed to wind a material 3 onto a winder core 20 or to unwind said material from the winder core 20, depending on whether the winder is at the beginning or end of the web-processing machine 1. As a result, it is always assumed that the material 3 is unwound from the winder core 20, but it is also always possible to wind the material 3 onto the winder core 20 in an analogous manner. The wound material 3 is pretensioned on the winder 2 and thus has a basic elongation $\epsilon_0$.

Furthermore, a traction roller 6 is provided that has a pressure roller 60 to transport the material between the traction roller 6 and the pressure roller 60 without slipping. The pressure roller 60 is not actively driven and is pressed against the traction roller 60. As a result of the coupling via the material 3, a change in the rotational speed of the winder 2 also has an effect on the traction roller 6. The traction roller 6 itself is driven at a traction roller speed v6, has no superimposed tractive force controller and thus represents the master. A line speed v of the material 3 is set by the traction roller speed v6. The line speed v is thus controlled by the circumferential speed of the traction roller 6, line speeds v of more than 1000 m/min being possible. The line speed v preferably has a trapezoidal profile, i.e. a linear increase from zero to the operating line speed $v_1$, $v_2$ at the beginning of the production process. The line speed v is kept constant at the desired operating line speed $v_1$, $v_2$ during the production process and is reduced linearly to zero again at the end of the production process.

The winder 2 has a winder speed v9', which is composed on the one hand of a set winder speed v9 and a correction speed Δv9. The circumferential speed of the winder 2 is kept constant such that the set winder speed v9 varies depending on the diameter of the winder 2. The correction speed Δv9 is specified by a tractive force controller 9 in order to control the winder speed v9'. The winder 2 is thus the actuator for controlling the tractive force F in the material 3. The actual tractive force $F_{actual}$ is measured as a process variable using a measuring unit 5, for example a load cell, and fed back to the tractive force controller 9. The tractive force controller 9 calculates the correction speed Δv9 from the actual tractive force $F_{actual}$ and the set tractive force $F_{set}$. Both the traction roller speed v6 and the set winder speed v9 are specified by the tractive force controller 9 only by way of example and can also be specified by a further component.

Because the winder 2 and the traction roller 6 are each connected in a contact region with the material 3 in a non-positive and slip-free manner, the line speed v can be equated approximately with the circumferential speed of the traction roller 6 and the winder 2. However, depending on the tractive force F that occurs, the circumferential speed of the winder 2 deviates minimally from the line speed v. Because the material 3 is unwound from the winder 2, it is advantageous if a change in the winder diameter is taken into account when determining the relationship between the circumferential speed of the winder 2 and the line speed v. For this purpose, the winder diameter can be measured or estimated.

If, on the other hand, a web-processing machine 1 has a dancer control, instead of the actual tractive force $F_{actual}$, a dancer position is provided as a process variable to be returned. If a web-processing machine 1 has tractive force management instead of a tractive force controller 9, no return of process variables is provided at all.

There are also optional deflection rollers 4 provided in FIG. 1, which serve to guide the material 3, but are not driven themselves. The mass moment of inertia of the deflection rollers 4 is low and can often be neglected. However, during acceleration and braking processes, it may well be necessary to take into account the mass moment of inertia of the deflection rollers 4 and to generate a smooth line speed profile in order to minimize negative inertia effects.

Figure 2:
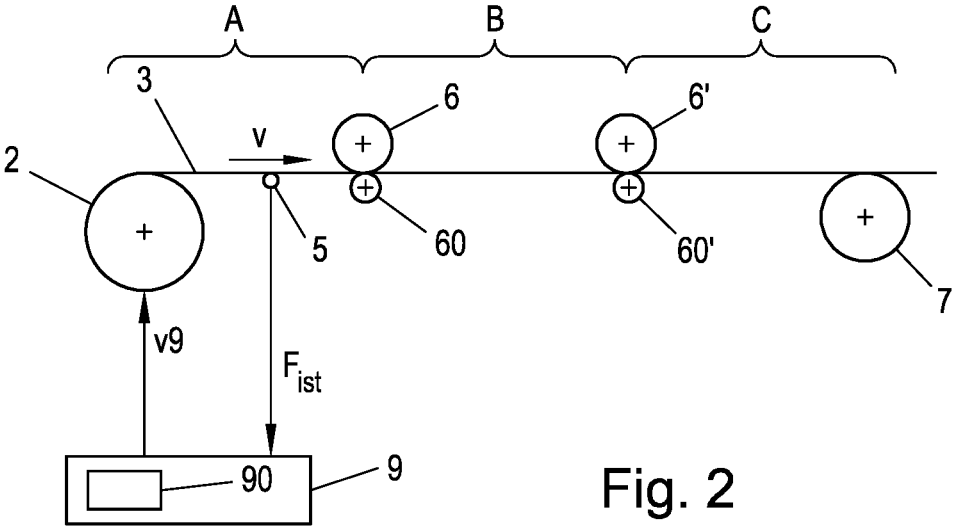
FIG. 2 shows zones of a web-processing machine.

A web-processing machine 1 usually consists of a plurality of sections, also called zones. In a web-processing machine 1, the term zone denotes a region between two driven rollers, between which the material 3 is clamped in a slip-free manner. The condition of the material 3 within a zone is influenced by the two driven rollers, which delimit the respective zone. In a zone, one roller serves as the master and one roller as the slave. It is often the case that at least three zones are planned in a web-processing machine 1: An entry zone A, a process zone B and an exit zone C, as indicated in FIG. 2. In the entry zone A, the material 3 is unwound from the winder 2 in that the corresponding tractive force $F_{actual}$ is controlled by the tractive force controller 9 in that said tractive force controller prescribes a winder speed $v_9'$ for the winder 2. Web movement control is preferably provided in the entry zone A, which web movement control corrects a lateral offset of the material 3. A material buffer can also be present in order to store material. These are constructions having deflection rollers that increase the distance from one another and thus can accommodate more material 3. This is particularly useful in the winding and unwinding region when a roll change is to be carried out without stopping the machine. During the roll change, the material is removed from the buffer; the web-processing machine does not have to be stopped during this time. A machining process (e.g. printing, packaging, coating, punching . . . ) takes place in process zone B, which is why the highest demands on the accuracy of the tractive force F are made in process zone B. In the exit zone C, the material 3 is removed and/or wound up on a winding-up device 7, as shown in FIG. 2. As in the entry zone A, web movement control and/or a material buffer can be provided in the exit zone C. After removal, the material 3 can be transferred to a further, for example discontinuous, process.

Because all rollers with which the material 3 is in non-positive contact (i.e. the winder 2, the traction roller 6, the further traction roller 6' and the winding-up device 7 in FIG. 2) are coupled by the material 3, the material properties of the material 3 can have a substantial influence on this coupling and thus on the design of the tractive force controller 9.

The line speed v is thus determined in a zone (entry zone A, process zone B, exit zone C) by a master, e.g. by the traction roller 6 in entry zone A. The entry zone A is subsequently considered. However, the calculation of the controller parameters is fundamentally also possible for tractive force controllers 9 in process zones B or exit zones C in an analogous manner—provided a master and a slave are provided.

Figure 3:
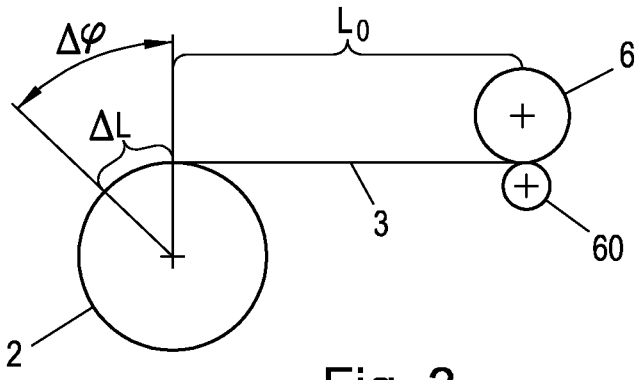
FIG. 3 shows an adjustment of a tractive force at a standstill.

At a standstill, i.e. at a line speed v of zero, the elongation of the material 3 can be determined via the position of the winder 2. The material 3 located between the winder 2 and the traction roller 6 has a basic length L0. Thus, the tractive force F in the entry zone A corresponds to the basic tractive force $F_0$ with which the material 3 was wound onto the winder 2. If, as shown in FIG. 3, the position of the winder 2 is changed by an adjustment angle $\Delta\varphi$, the result is a change in length of the material 3 by the length difference $\Delta L$, which results in a tractive force difference $\Delta F$. For the tractive force F, the sum of the basic tractive force F0 and the tractive force difference $\Delta F$ is: $F=F0+\Delta F$.

In order to change the tractive force F during operation, i.e. at a line speed v greater than zero, a corresponding correction speed $\Delta v9$ is, as mentioned, applied to the set winder speed v9 from which the winder speed v9' of the winder 2 results. At a constant correction speed $\Delta v9$, a constant change in tractive force $\Delta F$ occurs after a certain period, the magnitude of which is strongly dependent on the line speed v that occurs. As a master, the traction roller 6 therefore specifies a line speed v, and the winder speed v9' and thus the angular speed w of the winder 2 are changed via the correction speed $\Delta v9$ in such a way that the desired tractive force $F_{actual}$ is generated in the material 3. The winder 2 thus works, so to speak, against the traction roller 6 and thus generates the tractive force F in the material 3.

The angular speed $\omega$ of the winder 2 also changes at a constant line speed v as a function of the changed radius r of the winder 2 with $\omega=v/r$. To ensure that the circumferential speed of the winder 2 corresponds to the line speed v of the system, the angular speed co or the correction speed $\Delta v9$ must thus always be adapted to the current radius r.

The tractive force controller 9 can, for example, correspond to a PI controller, other types of controllers, for example PID controllers, state regulators, etc. also being possible.

Controller parameters $R_{F,v1}$, $R_{F,v2}$, $R_{F,vx}$ of the tractive force controller 9 can be determined for various operating line speeds $v_1$, $v_2$, $v_x$.

The material 3 can be in different forms (web, wire, etc.) and can consist of paper, fabric, plastics, metal, etc., for example. The material 3 can be viewed as a three-dimensional body. The material 3 has a length L that is initially at least roughly known and can subsequently be determined precisely. Furthermore, the material 3 has a modulus of elasticity E, which is usually not known. In addition, the material has a cross-section A, which is preferably known as precisely as possible in order to calculate the modulus of elasticity E from the line parameters (which represent the product of the cross-section and the modulus of elasticity E), e.g. from the fine line parameters—see below.

If the material 3 is subjected to a tractive force F in the longitudinal direction, a tractive stress $\sigma=F/A$ arises depending on the cross-sectional area A of the material. Assuming that the cross-sectional area A does not change significantly due to the tractive force F acting from the outside, the tractive stress $\sigma$ is directly proportional to the tractive force F. The tractive force F acting from the outside also generates an elongation $\epsilon$ of the material 3. For the design of the tractive force controller 9, only one region having a linear-elastic relationship of the tractive stress $\sigma$ and the elongation $\epsilon$ is considered. This means that, in this region, the elongation $\epsilon$ increases linearly with the tractive stress $\sigma$, the gradient being described by the modulus of elasticity E. If the tractive stress $\sigma$ is reduced again, the material 3 assumes the original length L again. The tractive stress in material 3 can be described with Hooke's law $\sigma=E*\epsilon$. Since the tractive stress $\sigma$ is assumed to be directly proportional to the tractive force F, it can also be assumed that the tractive force F is directly proportional to the elongation $\epsilon$. The elongation $\epsilon$ describes the relation between the change in length $\Delta L$ resulting from the application of the tractive force F and the initial length L0. The relationship between the elongation $\epsilon$ and the tractive force F results as $F=E*A*\epsilon$.

Figure 4:
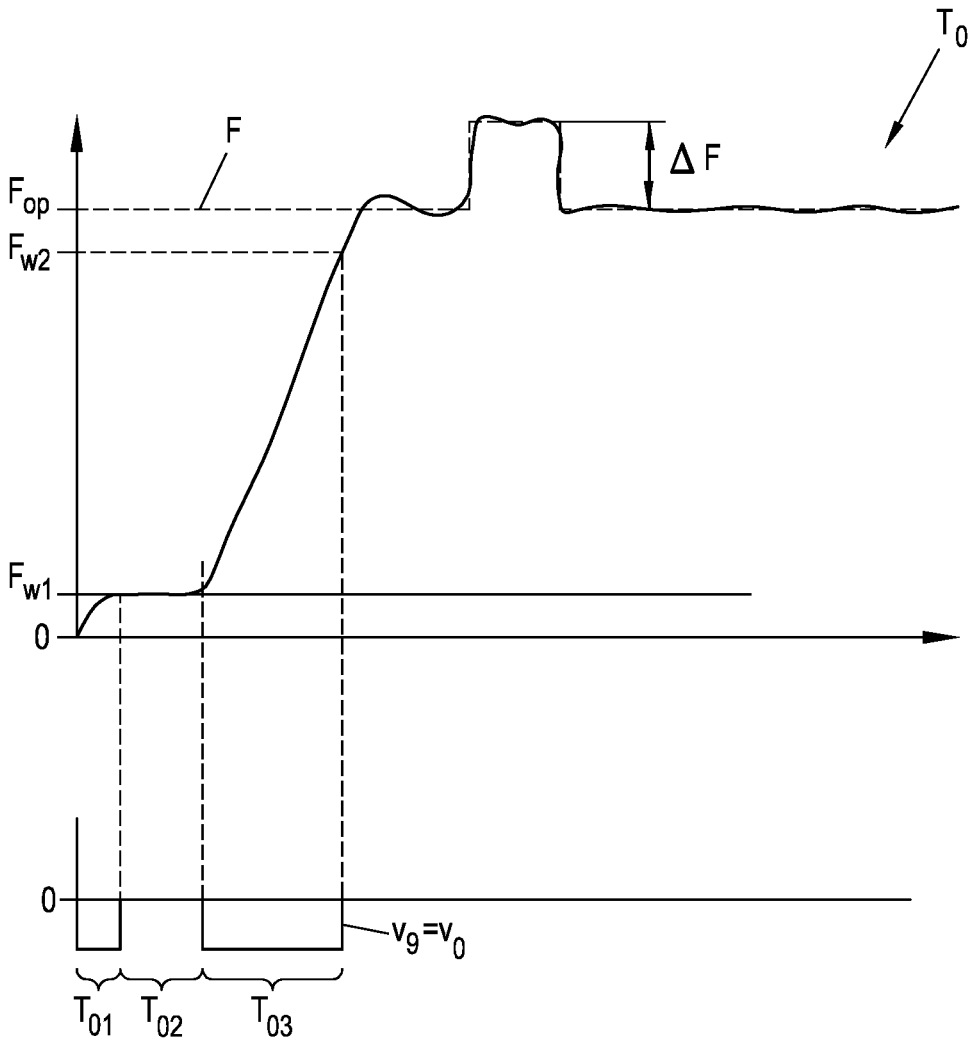
FIG. 4 shows a standstill test.

To determine the standstill controller parameters $R_{F,o}$, a standstill test $T_0$ having a line speed v of zero is carried out, an exemplary course of the tractive force F as well as the set winder speed $v_9$ being shown in FIG. 4. The implementation of the standstill test $T_0$ to determine the standstill controller parameters $R_{F,o}$ can be done on a parameterization unit 90, which can be an integral part of the tractive force controller 9.

During the standstill test $T_0$, the traction roller speed $v_6$ is zero. When the standstill test $T_0$ is carried out, the material 3 is stretched by a negative set winder speed $v_9=v_0$. This means that the set winder speed $v_9=v_0$ acts against the direction of rotation of the winder 2, which is present in a production operation. Because the traction roller 6 does not move or moves only negligibly, a counter-torque is built up, but the line speed v remains zero during the standstill test $T_0$. In a first portion $T_{01}$ of the standstill test $T_0$, the winder 2 is operated at the negative set winder speed $v_9=v_0$ until the tractive force F reaches a tensile tractive force $F_{w1}$, preferably 10% of the tractive force operating point $F_{op}$. Once the tractive force F has reached the tensile tractive force $F_{w1}$, a set winder speed $v_9$ of zero is again specified in an initialization phase Toa in order to keep the tractive force F constant at the tensile tractive force $F_{w1}$.

Subsequently, during an identification phase $T_{03}$, the tractive force F is increased to an identification tractive force $F_{w2}$, preferably 90% of the standstill tractive force operating point $F_{op}$, in that the negative set winder speed v9=v0 is again specified for the winder 2. In the identification phase $T_{03}$, the standstill controller parameters $R_{F,o}$ are determined from the standstill system parameters of the tractive force system $G_{F,0}$, which is preferably done by a frequency characteristic method.

The tractive force controller 9 can be parameterized using the standstill controller parameters $R_{F,o}$, whereupon the tractive force F is increased to the standstill tractive force operating point $F_{op}$. A jump ΔF can then be applied to the tractive force F in order to determine the quality of the standstill controller parameters $R_{F,o}$ using a first standstill quality step response g0, for example by a recursive best fit method.

Figure 5:
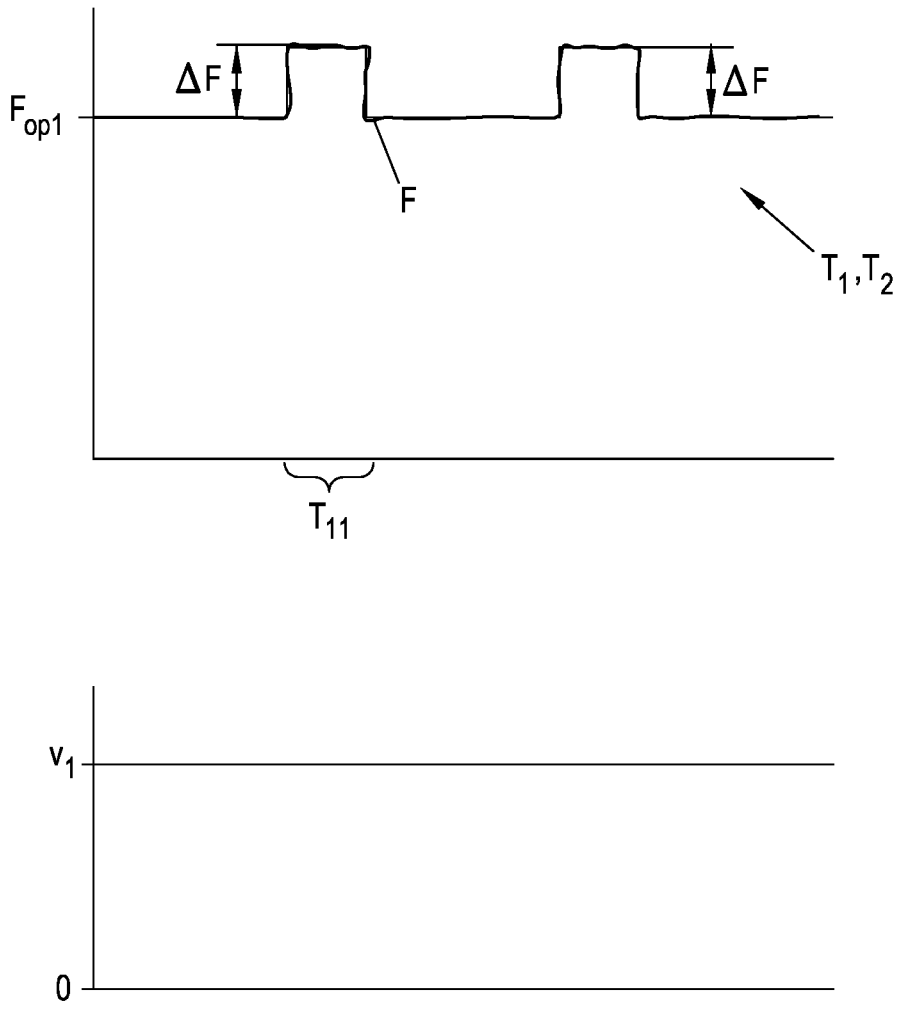
FIG. 5 shows a crawl test or a speed test.

If standstill controller parameters $R_{F,o}$ are of sufficient quality, a creep test T1 can be carried out in order to determine fine controller parameters $R_{F,v1}$ for a first operating line speed $v_1$, the tractive force F and the constant first line speed $v_1$ being shown in FIG. 5. The implementation of the creep tests T1 to determine the fine controller parameters $R_{F,v1}$ can also take place on the parameterization unit 90, but also on a separately designed fine parameterization unit.

During the creep test $T_1$, the material 3 is moved at a first operating line speed $v_1$. The tractive force controller 9 is parameterized using the standstill controller parameters $R_{F,o}$ determined during the standstill test $T_0$. During the creep test $T_1$, a first tractive force operating point $F_{op1}$, which can correspond to the standstill tractive force operating point $F_{op}$ of the standstill test $T_0$, is specified for the tractive force F. The tractive force controller 9 controls the set winder speed v9 of the winder 2 in order to regulate the tractive force F to the first tractive force operating point $F_{op1}$.

Identification in the case of a closed control loop has the advantage that unknown disturbances can be compensated for by the tractive force controller 9. However, it must also be taken into account that the controlled system is excited only by the correction speed $\Delta v_9$ supplied by the tractive force controller 9. A jump in tractive force ΔF is therefore applied to the tractive force F, which corresponds to a sudden change in the tractive force operating point $F_{op1}$ in order to ensure sufficient excitation of the controlled system. An identification phase $T_{11}$ starts again with the jump in tractive force ΔF. The fine system parameters $G_{F,v1}$ of the tractive force system for the first operating line speed $v_1$ are identified from a creep step response h1 by the (recursive) least squares method. Because the control loop is closed, the tractive force F ideally reaches the tractive force operating point $F_{op1}$ after the rise time $t_r$. Because the rise time $t_r$ was specified for the standstill controller, the tractive force controller 9 parameterized according to the standstill controller parameters $R_{F,o}$ does not necessarily have to be able to meet the rise time $t_r$ time in the creep test.

The fine controller parameters $R_{F,v1}$ for the first operating line speed $v_1$ are determined for the first operating line speed $v_1$ from the obtained first step response h1 and the determined fine track parameters $G_{F,v1}$ of the tractive force system. The modulus of elasticity E and/or the length L of the material 3 for the first operating line speed $v_1$ can be determined from the fine line parameters $G_{F,v1}$.

A second jump in tractive force ΔF can be applied to the tractive force F in order to determine the quality of the fine controller parameters $R_{F,v1}$ for the first operating line speed $v_1$ using a creep quality step response h2, which can be done by the recursive best fit method.

Analogously to the creep test $T_1$, a speed test $T_2$ can also be carried out, which corresponds to a creep test $T_1$ at a higher line speed $v_2$, preferably at a maximum line speed. The tractive force controller 9 is parameterized using the fine controller parameters $R_{F,v1}$ determined as part of the creep test $T_1$ in order to determine further fine controller parameters $G_{F,v2}$ for the second operating line speed $v_2$. The speed test $T_2$ can take place during the creep test $T_1$ by providing a second operating line speed $v_2$ and a tractive force F at the level of a second tractive force operating point $F_{op2}$, which corresponds, for example, to the first tractive force operating point $F_{op1}$. A jump in tractive force ΔF is applied to the tractive force F, a speed test step response h2 is determined and the further fine system parameters $G_{F,v2}$ of the tractive force system are identified from the speed test step response h2. Further fine controller parameters $R_{F,v2}$ are determined from the speed test step response h2 and the further fine system parameters $G_{F,v2}$. The quality of the fine controller parameters can also be checked by applying a jump in tractive force ΔF to the tractive force F.

The implementation of the speed tests $T_2$ to determine the further fine controller parameters $G_{F,v2}$ can also take place on the parameterization unit 90, but also on a further fine parameterization unit that is designed separately.

If no controller parameters were determined between the first operating line speed $v_1$ and the second (preferably maximum) operating line speed $v_2$, additional controller parameters $R_{F,vx}$ for additional operating line speeds $v_x$ can also be determined offline, i.e. without further test procedures. This can be done by performing a coefficient comparison as part of a frequency characteristic method, or by interpolation between the fine controller parameters $R_{F,v1}$ and the further fine controller parameters $R_{F,v2}$ along a function.

The additional controller parameters $R_{F,vx}$ determined for the additional line speeds $v_x$ (as well as the fine controller parameters $R_{F,v1}$ for the first operating line speed $v_1$ and/or the further fine controller parameters $R_{F,v2}$ for the second operating line speed $v_2$) can be stored as a parameter set for the tractive force controller 9 and called up during operation if required.

The parameterization unit 90 and/or the fine parameterization unit and/or the further fine parameterization unit can comprise microprocessor-based hardware, for example a computer or digital signal processor (DSP), on which appropriate software for performing the respective function is executed. The parameterization unit 90 and/or the fine parameterization unit and/or the further fine parameterization unit can also comprise an integrated circuit, for example an application-specific integrated circuit (ASIC) or a field programmable gate array (FPGA), also with a microprocessor. The parameterization unit 90 and/or the fine parameterization unit and/or the further fine parameterization unit can also comprise an analog circuit or an analog computer. Mixed forms are conceivable as well. It is also possible for different functions to be implemented on the same hardware.

An identification of system parameters of a tractive force system G(s) is shown below by way of example. The standstill system parameters of the tractive force system $G_{F,0}(s)$ are determined and used to determine the standstill controller parameters $R_{F,0}$ (standstill test $T_0$). Furthermore, the fine system parameters of the tractive force system $G_{F,v1}$ (s) are determined and used to determine the fine controller parameters $R_{F,v1}$ of a tractive force controller 9 (creep test $T_1$). The system parameters are identified first by a standstill test $T_0$, i.e. at a line speed v of zero, and then by a creep test $T_1$, i.e. at a line speed v not equal to 0.

The material 3 has a basic elongation $\epsilon_0$, the basic elongation $\epsilon_0$ in the case of lightly wound material 3 also being zero or at least negligible.

$$E = 2 \cdot 10^7 \frac{N}{m^2}$$

is assumed as the modulus of elasticity, L=4.5 m as the length, $A=2.8 \cdot 10^{-5}$ m as the cross-section and $\epsilon_0=0{,}1786$ as the basic elongation. The identification of the standstill system parameters of the tractive force system $G_{F,v0}(s)$ is initially carried out in an uncontrolled manner in the open control loop and then in the closed control loop.

The general transfer function of the tractive force system G(s) is described by $$G(s) = \frac{AE(1+\epsilon_0)}{sL+v} \text{ or } G(s) = \frac{b_0}{a_1 s + 1}$$

with the coefficients $$b_0 = \frac{AE(1+\epsilon_0)}{v} \text{ and } a_1 = \frac{L}{v}.$$

At line speeds v greater than 0, two standstill system parameters of the tractive force system $G_{F,v}(s)$ can be estimated, whereby the length L and the modulus of elasticity E can be determined.

For the standstill, i.e. a line speed v=0, the tractive force system $$G_{F,0}(s) = K_S \frac{1}{s} \text{ with } K_S = \frac{AE(1+\epsilon_0)}{L} \text{ applies.}$$

At a standstill, there is therefore only one coefficient $K_S$, which is why only one system parameter can be estimated here. The modulus of elasticity E can only be determined from this standstill system parameter if the length L of the material 3 is known.

A standstill test $T_0$ is now carried out with an open control loop, it being assumed that the material 3 in the web-processing machine 1 has a line speed v of 0 m/min. As shown in FIG. 4, a jump to the set winder speed $v_9$ of winder 2 is applied. A step response is also determined, i.e., tractive force F is observed to see how it behaves.

The standstill system parameters of the tractive force system $G_{F,0}(s)$ in the form of the coefficient $K_S$ are determined from the step response by the (recursive) least squares method. Thus, in this example, the result is the coefficient with $K_S=144.66$. With a known length L=4.5 m, the result for the modulus of elasticity is $$E = \frac{K_S L}{A(1+\epsilon_0)} = 1.97 \cdot 10^7 \frac{N}{m^2}.$$

Because all the required standstill system parameters of the tractive force system $G_{F,0}(s)$ are now known, the standstill controller parameters $R_{F,v0}$ can be determined and the controller can thus be designed.

The controller ultimately has the form $$R_F(s) = v_R\left(\frac{sT_R+1}{s}\right)$$

and is designed with the specifications $\omega_c t_r \approx 1.5$ and Ø[°]+ü[%]≈70, where $\omega_c$ is the crossover frequency of the open loop, $t_r$ is the rise time of the step response of the closed loop, Ø describes the phase reserve and ü describes the overshoot of the step response of the closed circuit.

The frequency characteristic method is now used. For this purpose, a desired rise time $t_r$ is specified, for example 0.17 s. This therefore results in a crossover frequency $$\omega_c = \frac{1.5}{t_r} = 8.823 \text{ Hz.}$$

With an overshoot ü of ü=10%, the phase reserve is Ø[°]=70−ü[%]=60°. The argument of the transfer function at the crossover frequency $\omega_c$ is calculated with $$G(j\omega) = \frac{K_S}{j\omega}$$

and $$\arg(G(j\omega)) = -90°.$$

The time constant $T_R$ is further calculated with $$T_R = \frac{1}{\omega_c}\tan(-90 + \phi - \arg(G(j\omega_c)) = 0.1963.$$

The time constant $T_R$ was thus determined as the first controller parameter $R_{F,v0}$.

The system at the crossover frequency is equal to:

$$|G(j\omega_c)| = \frac{|K_S|}{|j\omega_c|} = 16.40$$

This results in the amplification $$V_R = \frac{\omega_c}{|G(j\omega_c)|\sqrt{1+(T_R\omega_c)^2}} = 0.2690$$

for tractive force controller 9.

Thus, the time constant $T_R$ and the amplification $V_R$ were determined as standstill controller parameters $R_{F,0}$ for the controller $$R_F(s) = v_R\left(\frac{sT_R+1}{s}\right)$$

and the tractive force controller 9 was parameterized using these standstill controller parameters $R_{F,v0}$. The controller design for the standstill test $T_0$ is thus completed.

The tractive force controller 9 parameterized by the standstill test $T_0$ is now used to carry out a creep test $T_1$ in a closed control loop, it being assumed, for example, that the material 3 in the web-processing machine 1 has a line speed v of 15 m/min. A jump in tractive force ΔF is subsequently applied to the tractive force F, as shown in FIG. 5.

The fine system parameters of the tractive force system $G_{F,0}(s)$ are determined from the jump in tractive force ΔF in the form of the coefficients α1 and b0 using the (recursive) least squares method, which result, for example, with α1=18.095 and $b_0$=2691.1. Thus, the length $L=a_1$ v=4.52 m and the modulus of elasticity is equal to $$E = \frac{b_0 v}{A(1+\epsilon_0)} = 2.04 \cdot 10^7 \frac{N}{m^2}.$$

A comparison with the result determined above as part of the standstill test $T_0$ for the modulus of elasticity of $E=1.97*10^7$ N/m shows that the result of the standstill test was already sufficiently precise.

The determination of the fine controller parameters $R_{F,v1}$ of the tractive force controller 6 for the creep test $T_1$ takes place fundamentally analogously to the determination of the standstill controller parameters $R_{F,0}$ for the standstill test $T_0$.

For the determination of the standstill system parameters $G_{F,0}$, however, the tractive force F is increased to an identification tractive force $F_{w2}$, whereas a jump in tractive force ΔF is applied to determine the fine system parameters $G_{F,v1}$.

The argument of the transfer function at the crossover frequency $\omega_c$ is calculated with $$\arg(G(j\omega_c)) = \arg\left(\frac{b_0}{a_1 j\omega_c + 1}\right) = -89.64°.$$

The time constant $T_R$ is further calculated with $$T_R = \frac{1}{\omega_c}\tan(-90 + \phi + \arg(G(j\omega_c)) = 0.1929.$$

The time constant $T_R$ was thus determined as the controller parameter $R_{F,v1}$.

The system at the crossover frequency is:

$$|G(j\omega_c)| = \frac{|b_0|}{|1 + a_1 j\omega_c|} = 16.86.$$

This results in the amplification $$V_R = \frac{\omega_c}{|G(j\omega_c)|\sqrt{1 + (T_R\omega_c)^2}} = 0.2651$$

for the tractive force controller 9.

Thus, the time constant $T_R$ and the amplification $V_R$ are determined as fine controller parameters $R_{F,v1}$ for the controller $$R_F(s) = v_R\left(\frac{sT_R + 1}{s}\right).$$

The controller design for the creep test is thus complete, whereby the tractive force controller 9 can be parameterized using the fine controller parameters $R_{F,v1}$.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for parameterization of a tractive force controller of a controlled roller of a web-processing machine, the tractive force controller controlling a speed of the controlled roller in order to transport a material on the web-processing machine from the controlled roller to a traction roller or from a traction roller to the controlled roller at a line speed and while being subjected to the tractive force, comprising:

during a standstill test at a line speed of zero, increasing the tractive force to an identification tractive force to determine standstill system parameters of the tractive force system, to calculate standstill controller parameters of the tractive force controller from the standstill system parameters of the tractive force system, and to parameterize the tractive force controller using the standstill controller parameters.

2. The method according to claim 1, wherein the standstill system parameters of the tractive force system are determined by a least square method.

3. The method according to claim 2, wherein the standstill system parameters of the tractive force system are determined by a recursive least square method.

4. The method according to claim 1, wherein the standstill controller parameters are calculated by a frequency characteristic method.

5. The method according to claim 1, wherein a modulus of elasticity of the material is determined from the standstill system parameters of the tractive force system.

6. The method according to claim 1, wherein the tractive force is increased to a tensile tractive force before the increase to the identification tractive force.

7. The method according to claim 6, wherein the tensile tractive force is 10% of the standstill tractive force operating point.

8. The method according to claim 1, further comprising increasing the tractive force to the standstill operating tractive force, and after the tractive force operating point is reached, applying a jump in tractive force to the tractive force in order to determine the quality of the standstill controller parameters using a first standstill quality step response.

9. The method according to claim 1, wherein, after the standstill test, the method further comprises carrying out a creep test, wherein a first operating line speed and a tractive force at the level of a first tractive force operating point is provided, and a jump in tractive force is applied to the tractive force, to determine a creep step response and to identify fine system parameters based on the creep step response of the tractive force system, wherein fine controller parameters are calculated from the creep step response and the creep system parameters, and wherein the tractive force controller is parameterized using the fine controller parameters.

10. The method according to claim 9, wherein the fine system parameters of the tractive force system are identified by a least square method.

11. The method according to claim 10, wherein the fine system parameters of the tractive force system are identified by a recursive least square method.

12. The method according to claim 9, wherein the fine controller parameters are determined by a frequency characteristic method.

13. The method according to claim 9, wherein at least one of a modulus of elasticity or a length of the medium is calculated from the fine system parameters for the first operating line speed.

14. The method according to claim 9, wherein a jump in tractive force is applied to the tractive force in order to determine the quality of the fine controller parameters for the first operating line speed using a creep quality step response.

15. The method according to claim 14, wherein the quality of the fine controller parameters for the first operating line speed are determined by the best fit method.

16. The method according to claim 9, further comprising storing the fine controller parameters for the first operating line speed, wherein, during operation of the web-processing machine at a line speed within a range of the first operating line speed, the fine controller parameters for parameterizing the tractive force controller are called up.

17. The method according to claim 9, further comprising carrying out a speed test after the creep test, wherein a second operating line speed and a tractive force at the level of a second tractive force operating point being provided, and wherein a jump in tractive force is applied to the tractive force, to determine a speed test step response and identify further fine system parameters of the tractive force system, wherein the further fine controller parameters are calculated from the speed test step response and the further fine system parameters, and wherein the tractive force controller is parameterized using the further fine controller parameters.

18. The method according to claim 17, further comprising storing the further fine controller parameters for the second operating line speed, wherein, during operation of the web-processing machine at a line speed within the range of the second operating line speed, other fine controller parameters for parameterizing the tractive force controller are called up and the tractive force controller is parameterized using the further fine controller parameters.

19. The method according to claim 17, wherein additional fine controller parameters for additional operating line speeds are determined from the fine controller parameters and the further fine controller parameters, and wherein the tractive force controller is parameterized using the additional fine controller parameters.

20. The method according to claim 19, further comprising storing the additional fine controller parameters for the additional operating line speeds, wherein during operation of the web-processing machine at a line speed within the range of the respective additional operating line speed with the associated fine controller parameters, the associated additional fine controller parameters are called up to parameterize the tractive force controller and the tractive force controller is parameterized using the associated additional fine controller parameters.

21. The method according to claim 1, further comprising storing the standstill controller parameters, wherein extrapolation speed controller parameters for a number of extrapolation line speeds are extrapolated from the standstill controller parameters, and wherein during operation of the web-processing machine at a line speed within the range of one of the extrapolation line speeds, the associated extrapolation speed controller parameters for parameterizing the tractive force controller are called up.

22. A method of using a tractive force controller parameterized according to a method according to claim 1 for controlling a tractive force of a material in a web-processing machine, comprising:

while being subjected to the tractive force, transporting the material from a controlled roller to a traction roller or from a traction roller to a controlled roller at a line speed.

23. The method according to claim 1, wherein the identification tractive force is 90% of a predetermined standstill tractive force operating point.

24. The method according to claim 1, wherein the standstill controller parameters of the tractive force controller are calculated from the standstill system parameters of the tractive force system by a frequency characteristic method.

25. A parameterization unit for parameterization of a tractive force controller of a controlled roller of a web-processing machine on which a material is transported from the controlled roller to a traction roller or from a traction roller to a controlled roller at a line speed, subjected to a tractive force, the tractive force being controllable via a speed of the controlled roller by the tractive force controller, comprising:

during a standstill test at a line speed of zero, parameterization unit is configured to increase the tractive force to an identification tractive force to determine the standstill system parameters of the tractive force system and to calculate standstill controller parameters of the tractive force controller from the standstill system parameters of the tractive force system, and to parameterize the tractive force controller with the standstill controller parameters.

26. The method according to claim 25, wherein the identification tractive force is 90% of a predetermined standstill tractive force operating point.

27. The method according to claim 25, wherein the standstill controller parameters of the tractive force controller are calculated from the standstill system parameters of the tractive force system by a frequency characteristic method.

* * * * *